US009021942B2

(12) United States Patent
Lee et al.

(10) Patent No.: US 9,021,942 B2
(45) Date of Patent: May 5, 2015

(54) COOKER

(75) Inventors: Jongho Lee, Seoul (KR); Jeahyuk Wie, Seoul (KR)

(73) Assignee: LG Electronics Inc., Seoul (KR)

( * ) Notice: Subject to any disclaimer, the term of this patent is extended or adjusted under 35 U.S.C. 154(b) by 407 days.

(21) Appl. No.: 13/446,961

(22) Filed: Apr. 13, 2012

(65) Prior Publication Data

US 2012/0266758 A1 Oct. 25, 2012

(30) Foreign Application Priority Data

Apr. 22, 2011 (KR) ..... 10-2011-0038060

(51) Int. Cl.

| | |
|---|---|
| ***A21B 1/00*** | (2006.01) |
| ***F24C 3/08*** | (2006.01) |
| ***F24C 15/00*** | (2006.01) |
| ***F24C 15/20*** | (2006.01) |

(52) U.S. Cl.

CPC ..... *F24C 3/085* (2013.01); *F24C 15/006* (2013.01); *F24C 15/2007* (2013.01)

(58) Field of Classification Search

CPC .... F24C 15/2007; F24C 15/20; F24C 15/006; F24C 15/32; F24C 15/322; F24C 15/325

USPC ..... 99/467, 449, 473, 476; 126/273 R, 21 R, 126/21 A, 15 R; 219/394, 395, 757

See application file for complete search history.

(56) References Cited

U.S. PATENT DOCUMENTS

| | | | | |
|---|---|---|---|---|
| 4,598,691 | A * | 7/1986 | Herrelko et al. | 126/41 R |
| 4,601,279 | A * | 7/1986 | Guerin | 126/21 |
| 4,796,600 | A * | 1/1989 | Hurley et al. | 126/273 A |
| 6,761,159 | B1 * | 7/2004 | Barnes et al. | 126/21 R |
| 7,348,527 | B2 * | 3/2008 | Braunisch et al. | 219/757 |
| 2004/0251253 | A1 * | 12/2004 | Zenter et al. | 219/757 |
| 2011/0067684 | A1 * | 3/2011 | Kwag et al. | 126/21 R |

* cited by examiner

*Primary Examiner* — Reginald L Alexander
(74) *Attorney, Agent, or Firm* — Birch, Stewart, Kolasch & Birch, LLP

(57) ABSTRACT

A cooker is provided. The cooker includes a casing, a cavity part in the casing and including a cooking chamber to cook food, and an exhaust duct through which exhaust gas is discharged. The exhaust duct includes a first duct part having a lower end communicating with the cooking chamber, a second duct part extending from the other end of the first duct part, the second duct part making a predetermined angle with respect to the first duct part or having a predetermined curvature, and a flow passage extension protruded from a portion of the first duct part or the second duct part in an outward direction. At least a portion of the flow passage extension extends at an angle different from the predetermined angle between the first and second duct parts or the flow passage extension has a curvature different from the predetermined curvature of the second duct part.

12 Claims, 13 Drawing Sheets

COOKER

CROSS-REFERENCE TO RELATED APPLICATIONS

The present application claims priority under 35 U.S.C. 119 to Korean Patent Application No. 10-2011-0038060, filed on Apr. 22, 2011, which is hereby incorporated by reference in its entirety.

BACKGROUND OF THE DISCLOSURE

1. Field of the Disclosure

The present disclosure relates to a cooker.

2. Description of Related Art

Cookers are used to cook food by heating the food using gas or electricity. Cookers using gas as fuel include a burner for heating food. In addition, such cookers using gas as fuel include an exhaust duct to discharge exhaust gas while food is cooked in a cooking chamber by using the burner. Problems occur if the exhaust gas is not efficiently discharged during operation.

BRIEF SUMMARY OF THE DISCLOSURE

Exemplary embodiments provide a cooker in which exhaust gas can be discharged from a cooking chamber more efficiently.

In one exemplary embodiment, a cooker is provided. The cooker includes a casing defining an exterior of the cooker, a cavity part disposed in the casing and including a cooking chamber configured to cook food, and an exhaust duct through which exhaust gas is discharged from the cooking chamber to an outside area of the casing. The exhaust duct includes a first duct part having a lower end communicating with the cooking chamber, a second duct part extending from the other end of the first duct part, the second duct part making a predetermined angle with respect to the first duct part or having a predetermined curvature, and a flow passage extension protruded from a portion of the first duct part or the second duct part in an outward direction. And at least a portion of the flow passage extension extends at an angle different from the predetermined angle between the first and second duct parts or the flow passage extension has a curvature different from the predetermined curvature of the second duct part.

In another exemplary embodiment, a cooker includes a casing defining an exterior of the cooker, an upper cavity part disposed in the casing and including an upper cooking chamber configured to cook food, an upper burner configured to supply energy to the upper cooking chamber for cooking food, an upper exhaust duct to which exhaust gas flows from the upper cooking chamber, a lower cavity part disposed in the casing under the upper cavity part and including a lower cooking chamber configured to cook food, a lower burner configured to supply energy to the lower cooking chamber for cooking food, and a lower exhaust duct to which exhaust gas flows from the lower cooking chamber. The upper exhaust duct includes a first duct part having a lower end communicating with the upper cooking chamber, the first duct part being sloped at a first angle with respect to a top surface of the upper cavity part, a second duct part communicating with an upper end of the first duct part, the second duct part being sloped at a second angle with respect to the top surface of the upper cavity part or the second duct part having a predetermined curvature, and a flow passage extension protruded from a portion of the first duct part or the second duct part in an outward direction. And at least a portion of the flow passage extension extends at an angle different from the first and second angles or the flow passage extension has a curvature different from the predetermined curvature of the second duct part.

The details of one or more exemplary embodiments are set forth in the accompanying drawings and the description below. Other features will be apparent from the description and drawings, and from the claims.

BRIEF DESCRIPTION OF THE DRAWINGS

The present disclosure will become more fully understood from the detailed description given hereinbelow and the accompanying drawings which are given by way of illustration only, and thus are not limitative of the present disclosure and wherein.

DETAILED DESCRIPTION OF THE DISCLOSURE

Hereinafter, an explanation will be given of a cooker according to various exemplary embodiments with reference to the accompanying drawings.

Figure 1:
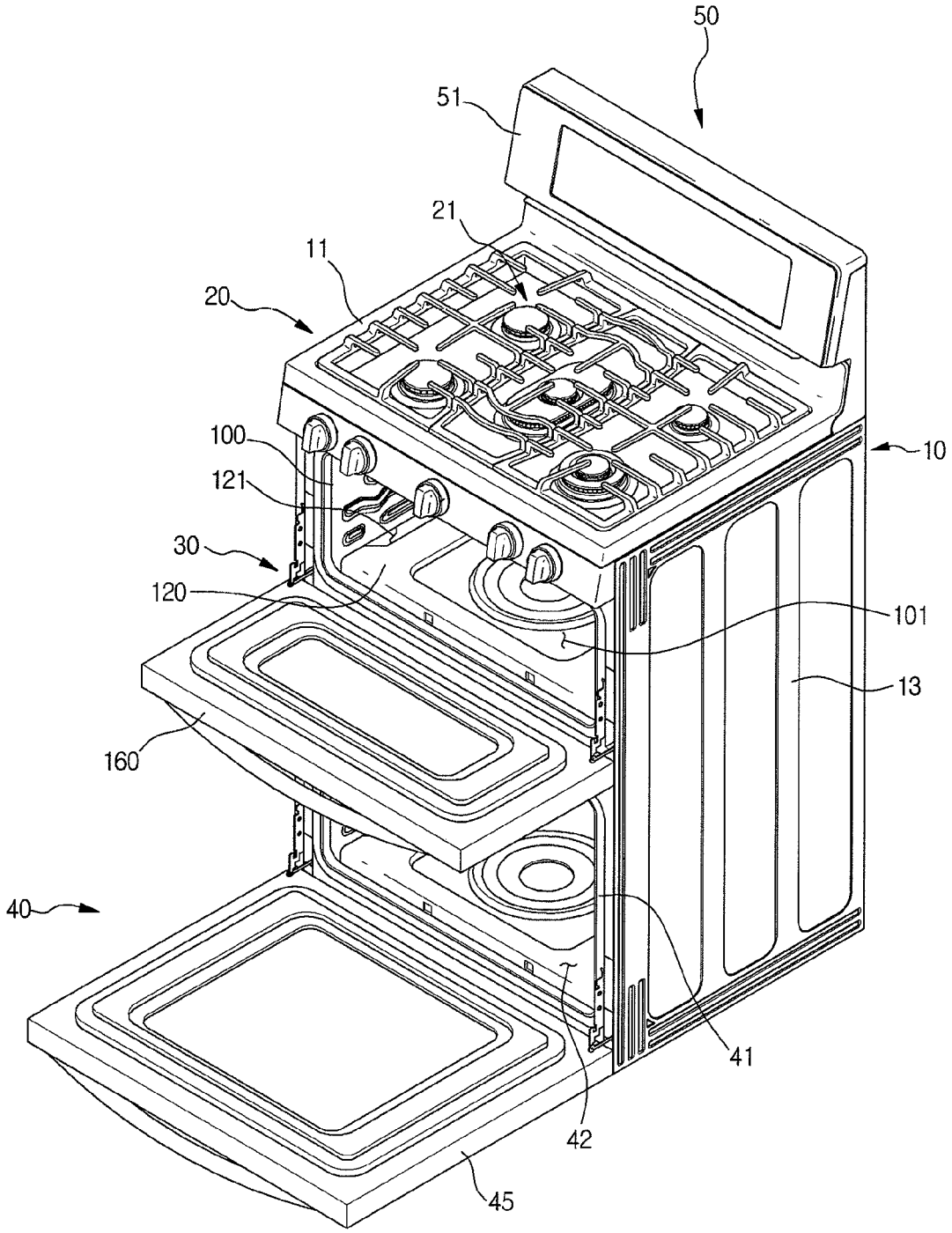
FIG. 1 is a perspective view illustrating a cooker according to a first exemplary embodiment.
Figure 2:
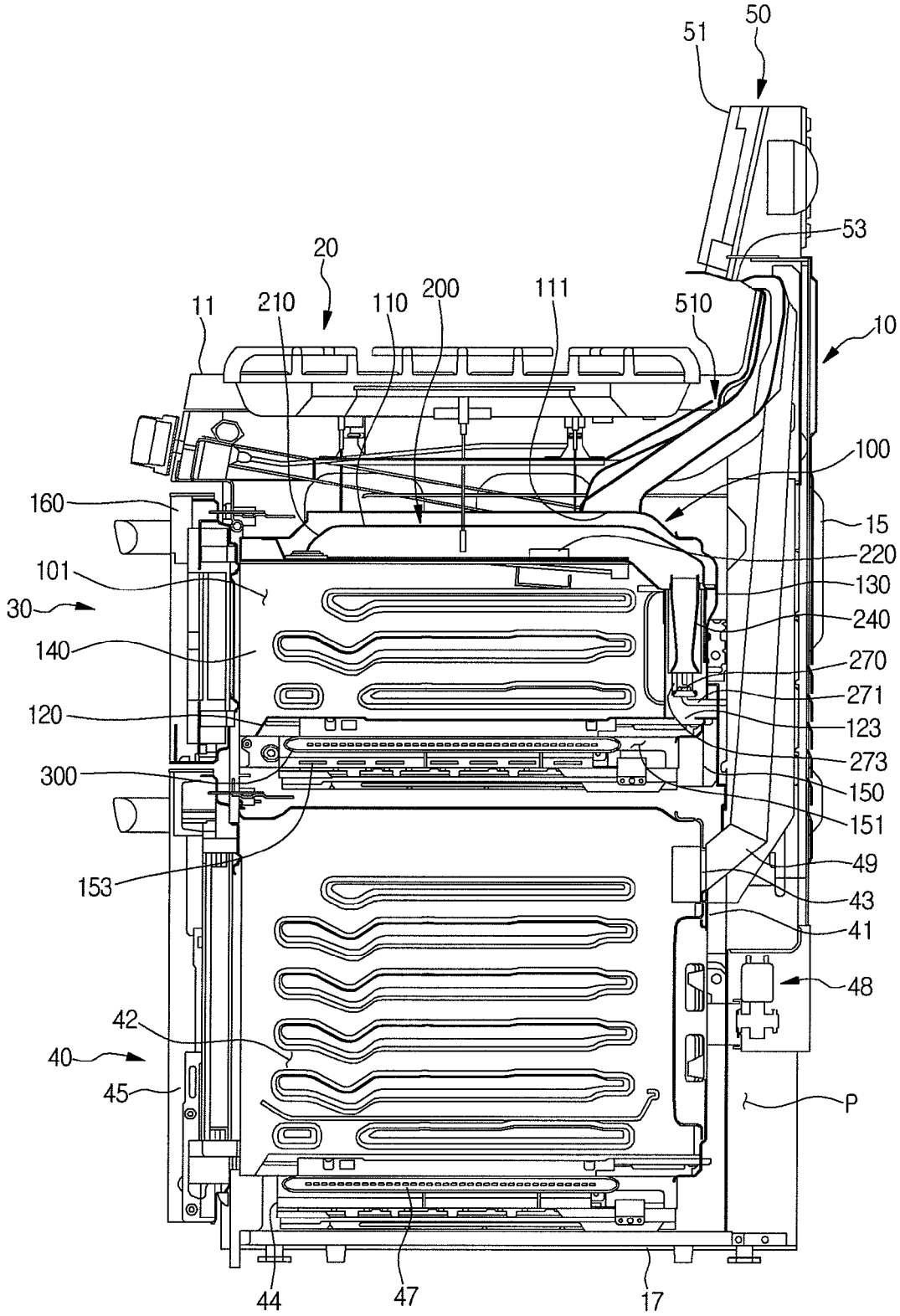
FIG. 2 is a vertical sectional view illustrating main parts of the cooker of the first exemplary embodiment.
Figure 3:
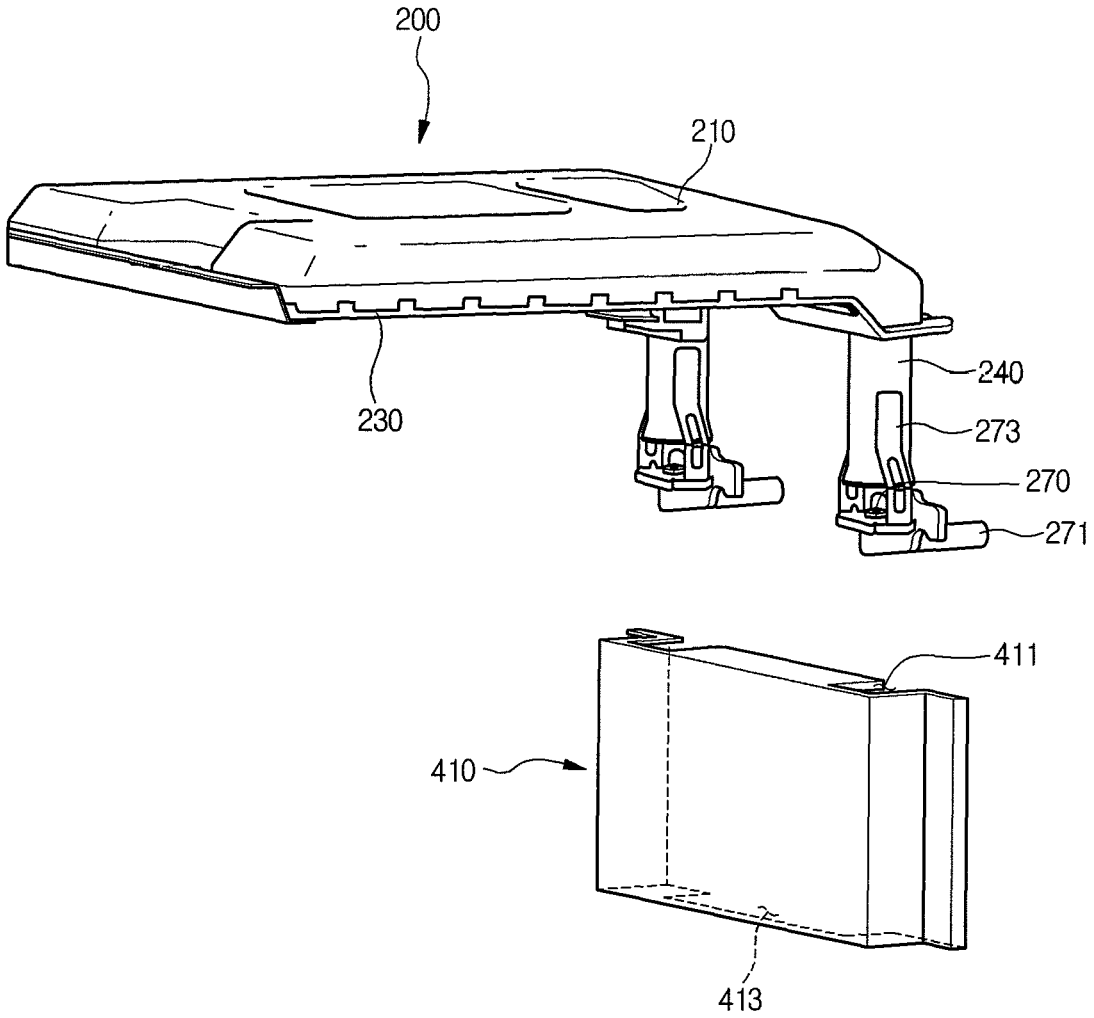
FIG. 3 is an exploded perspective view illustrating main parts of the cooker of the first exemplary embodiment.
Figure 4:
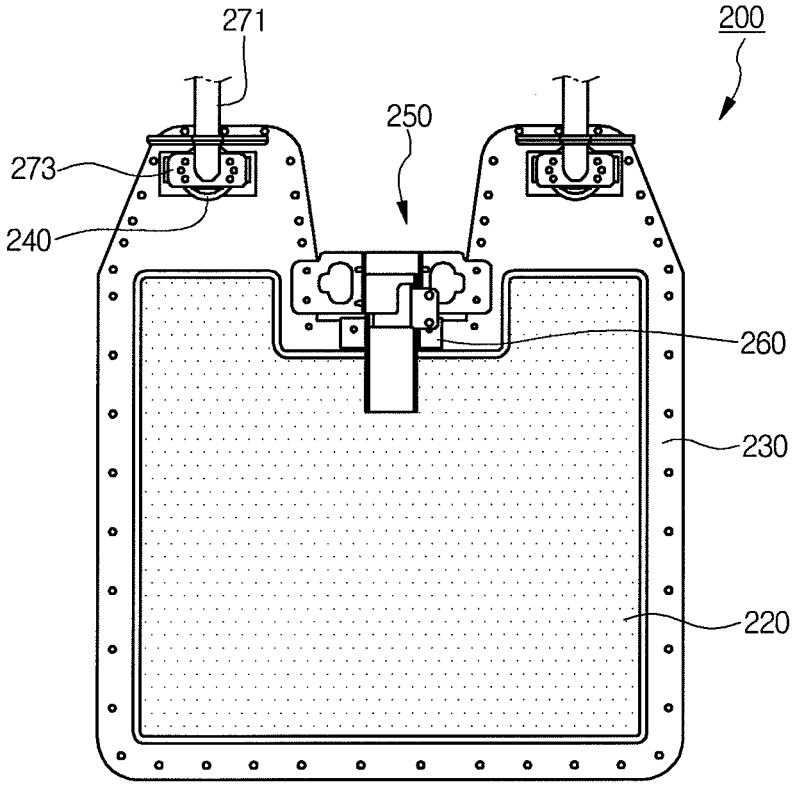
FIG. 4 is a plan view illustrating an upper broil burner according to the first exemplary embodiment.

Referring to FIGS. 1 to 3, the cooker includes a casing 10 forming the exterior of the cooker. The casing 10 has an approximately hexahedral shape with front openings. A top plate 11 is disposed on the topside of the casing 10. A rear end part of the top plate 11 is bent upward at a preset angle, for example, right angle. Side panels 13 are disposed on both sides of the casing 10, and a back cover 15 is disposed on the backside of the casing 10. A bottom plate 17 is disposed on the bottom side of the casing 10. Intake inlets (not shown) are formed in both lateral ends of the bottom plate 17 so that air can be sucked or drawn into the casing 10.

A flow passage (P) is formed in the casing 10. Air sucked into the casing 10 through the intake inlets is guided along the flow passage (P). The flow passage (P) may be formed between the back cover 15 and rear sides of upper and lower cavity parts 100 and 41 (described later). In addition, the flow passage (P) may be formed between the side panels 13 and both sides of the upper and lower cavity parts 100 and 41.

A cooktop 20, an upper oven 30, a lower oven 40, and a control part 50 are provided on or in the casing 10. The cooktop 20 is disposed on the topside of the casing 10. The upper oven 30 and the lower oven 40 are disposed in the casing 10. The control part 50 is disposed on a rear end of the topside of the casing 10.

More particularly, the cooktop 20 includes a plurality of cooktop burners 21. The cooktop burners 21 are disposed on the topside of the casing 10. That is, the cooktop burners 21 are disposed on the topside of the top plate 11. As mixture gas discharged through the cooktop burners 21 is combusted, containers in which foods are contained may be heated by flames generating as a result of the combustion.

The upper oven 30 is disposed in the casing 10 under the cooktop 20. The upper oven 30 includes the upper cavity part 100 in which an upper oven chamber 101 is formed, a burner cover 150 disposed on the bottom side of the upper cavity part 100, an upper door 160 used to selectively open and close the upper oven chamber 101, an upper heating source configured to heat the inside of the upper oven chamber 101 for cooking food, and an upper exhaust duct 510 through which exhaust gas is discharged to the outside of the upper oven chamber 101. Herein, the term exhaust gas is used to indicate a gaseous matter such as gas generated as a result of combustion, steam, smoke, fumes, and a remaining air-gas mixture.

The upper cavity part 100 has an approximately hexahedral shape with an opened front side. The upper cavity part 100 may be disposed in the casing 10 under the top plate 11. The topside, bottom side, rear side, and both lateral sides of the upper cavity part 100 are formed by an upper plate 110, a base plate 120, a rear plate 130, and side plates 140, respectively.

An upper exhaust outlet 111 formed in the upper plate 110. Exhaust gas is discharged from the upper oven chamber 101 through the upper exhaust outlet 111. The upper exhaust outlet 111 may be formed by cutting a portion of the upper plate 110.

Heat supply openings 121 are formed in the base plate 120. High-temperature air is supplied from a burner chamber 151 (described later) to the upper oven chamber 101 through the heat supply openings 121. The heat supply openings 121 are formed in both lateral end parts of the base plate 120. The heat supply openings 121 may extend in a front-to-rear direction. In addition, secondary air is supplied to the upper broil burner 200 (described later) substantially through the heat supply openings 121. Thus, the heat supply openings 121 may be referred to as secondary air supply openings.

Air supply openings 123 are formed in the base plate 120. The air supply openings 123 may be formed by cutting a portion of a rear end part of the base plate 120. Air is supplied from the burner chamber 151 to the upper broil burner 200 through the air supply openings 123. Generally, primary air is supplied through the air supply openings 123 to the upper broil burner 200. Thus, the air supply openings 123 may be referred to as primary air supply openings.

In the current exemplary embodiment, the base plate 120 is formed as a separate part and is fixed to the upper cavity part 100. That is, in the current exemplary embodiment, the upper cavity part 100 has a polyhedral shape with opened front and bottom sides. The bottom side of the upper cavity part 100 is formed by the base plate 120 fixed to the upper cavity part 100. However, in other exemplary embodiments, the base plate 120 and the upper cavity part 100 may be formed as one piece.

The burner cover 150 defines the base plate 120 and the burner chamber 151. An upper bake burner 300 (described later) is disposed in the burner chamber 151. The burner cover 150 is disposed on the bottom side of the upper cavity part 100 (that is, on the base plate 120) so as to cover the air supply openings 123. Substantially, the upper oven chamber 101 and the burner chamber 151 communicate with each other through the air supply openings 123. In addition, a plurality of air supply holes 153 is formed in the burner cover 150. Air is supplied from the inside of the casing 10 to the burner chamber 151 through the air supply holes 153. That is, some of air sucked into the casing 10 through the intake inlets is supplied to the burner chamber 151 through the air supply holes 153.

The upper heating source includes the upper broil burner 200 and the upper bake burner 300. The upper broil burner 200 heats food disposed in the upper oven chamber 101 by radiation. The upper bake burner 300 heats air supplied into the upper cavity part 100. In the current exemplary embodiment, the upper broil burner 200 and the upper bake burner 300 may be alternately operated. That is, in the upper oven chamber 101, food may be cooked by the upper broil burner 200 or the upper bake burner 300.

The upper broil burner 200 is disposed in an upper region of the upper oven chamber 101. In the current exemplary embodiment, an infrared burner may be used as the upper broil burner 200. More particularly, the upper broil burner 200 includes a burner port 210, a combustion member 220, a port cover 230, mixing tubes 240, an ignition unit 250, and a gas guide member 260.

The burner port 210 has an approximately polyhedral shape with an opened bottom side. A mixture of gas and air is supplied into the burner port 210.

The combustion member 220 is disposed on the bottom surface of the burner port 210. The combustion member 220 may be formed of a porous material such as a ceramic material. Mixture gas supplied into the burner port 210 is burned on the surface of the combustion member 220 as the mixture gas passes through the combustion member 220. Generally, the combustion member 220 blocks a flow passage formed in the burner port 210. While mixture gas is burned on the surface of the combustion member 220 as described above, secondary air is supplied through the heat supply openings 121.

The port cover 230 fixes the combustion member 220 disposed on the bottom surface of the burner port 210. For this, the port cover 230 is fixed to the burner port 210 after the combustion member 220 is placed on the bottom surface of the burner port 210. The port cover 230 may be fixed to the burner port 210 by bringing the top surface of the port cover 230.

Gas and air are mixed in the mixing tubes 240 and then supplied to the burner port 210. In the current exemplary embodiment, two mixing tubes 240 extend downward from the bottom rear end of the burner port 210. The mixing tubes 240 may be fixed to the bottom surface of the burner port 210 by welding or using fasteners. In a state where the upper broil burner 200 is disposed in the upper oven chamber 101, lower ends of the mixing tubes 240 are disposed close to the air supply openings 123. That is, primary air is supplied to the mixing tubes 240 from the air supply openings 123.

The ignition unit 250 ignites mixture gas flowing on the surface of the combustion member 220. The ignition unit 250 is fixed to a side of the port cover 230 and is spaced a predetermined distance from the combustion member 220 in a downward direction. The ignition unit 250 is heated to a higher temperature for igniting mixture gas discharged through the combustion member 220.

Mixture gas discharged through a predetermined region of the combustion member 220 is guided to the ignition unit 250 by the gas guide member 260. The gas guide member 260 is fixed to a position of the burner port 210 close to the ignition unit 250. Generally, the gas guide member 260 is disposed between the combustion member 220 and the ignition unit 250.

Gas is injected into the mixing tubes 240 through nozzles 270. For this, the nozzles 270 are coupled to gas pipes 271 which extend into the upper oven chamber 101 through the rear plate 130. In the current exemplary embodiment, the nozzles 270 are fixed to the mixing tubes 240 by nozzle holders 273. The nozzles 270 are spaced a predetermined distance from the bottom ends of the mixing tubes 240. Gas injected through the nozzles 270 is supplied into the mixing tubes 240 together with primary air supplied along the air supply openings 123.

Referring again to FIGS. 1 to 3, the upper bake burner 300 is disposed in the burner chamber 151. A general gas burner including a plurality of flame holes may be used as the upper bake burner 300. Generally, the upper bake burner 300 may heat air in the burner chamber 151.

In the current exemplary embodiment, a barrier member 410 is disposed in the upper oven chamber 101. As a result of the barrier member 410, air and gas to be mixed and supplied into the upper broil burner 200 can be prevented from being heated by a high-temperature atmosphere in the upper oven chamber 101. That is, the barrier member 410 may block flows of air from the inside of the upper oven chamber 101 into the mixing tubes 240. For this, the barrier member 410 divides the inside of the upper oven chamber 101 into a region for cooking a food and a region for supplying air and gas. Therefore, the barrier member 410 may be referred to as a compartment member. In the following description, one of the inside regions of the upper oven chamber 101 defined by the barrier member 410 will be referred to as a cooking region, and the other will be referred to as a mixing region. In the cooking region, food may be cooked, and in the mixing region, air and gas may be supplied. The mixing tubes 240 and the nozzles 270 are disposed substantially in the mixing region.

In the current exemplary embodiment, the barrier member 410 has a polyhedral shape with an opened rear side. In addition, the barrier member 410 is fixed to the front side of the rear plate 130. The topside of the barrier member 410 is disposed on the bottom side of the upper broil burner 200, that is, the bottom side of the port cover 230. The bottom side of the barrier member 410 is disposed on the topside of the base plate 120. Communication openings 411 are formed in the top surface of the barrier member 410, and a communication opening 413 is formed in the bottom surface of the barrier member 410.

When the barrier member 410 is installed, the mixing tubes 240 are disposed through the communication openings 411. The communication opening 413 communicates with the air supply openings 123. Therefore, a space defined by the front side of the rear plate 130 and the inner surface of the barrier member 410 is isolated from the upper oven chamber 101 where food may be cooked, but the space communicates with the burner chamber 151 through the air supply openings 123. The mixing tubes 240 are disposed in the space between the rear plate 130 and the barrier member 410.

Exhaust gas of the upper oven chamber 101 is discharged to the outside of the casing 10 through the upper exhaust duct 510. In other words, exhaust gas of the upper oven chamber 101 flows along the upper exhaust duct 510 and is then discharged to the outside of the casing 10. The lower end of the upper exhaust duct 510 communicates with the upper exhaust outlet 111, and the upper end of the upper exhaust duct 510 communicates with an exhaust slot 53.

Figure 5:
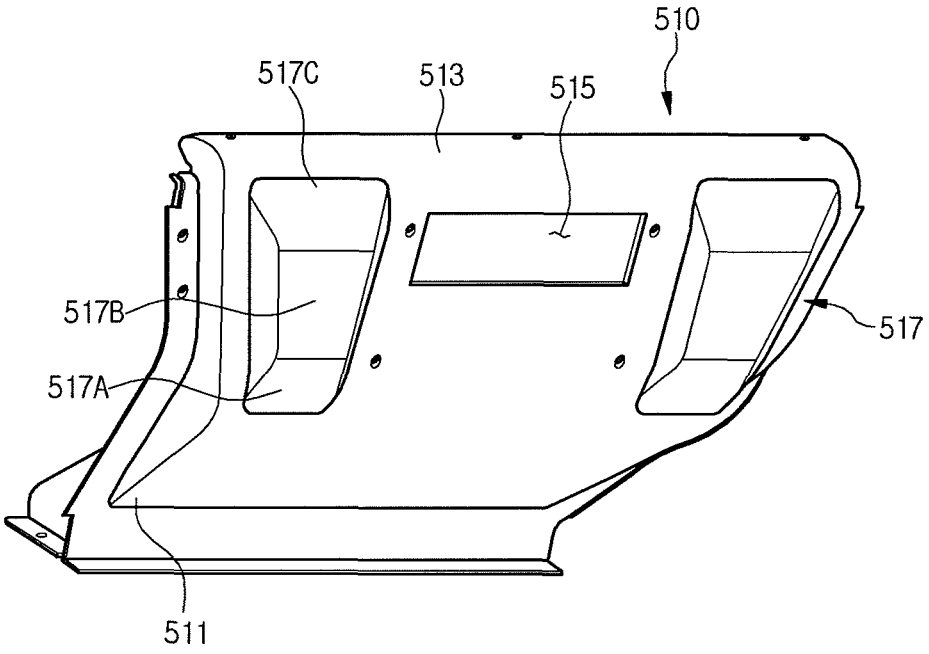
FIG. 5 is a perspective view illustrating an upper exhaust duct according to the first exemplary embodiment.
Figure 6:
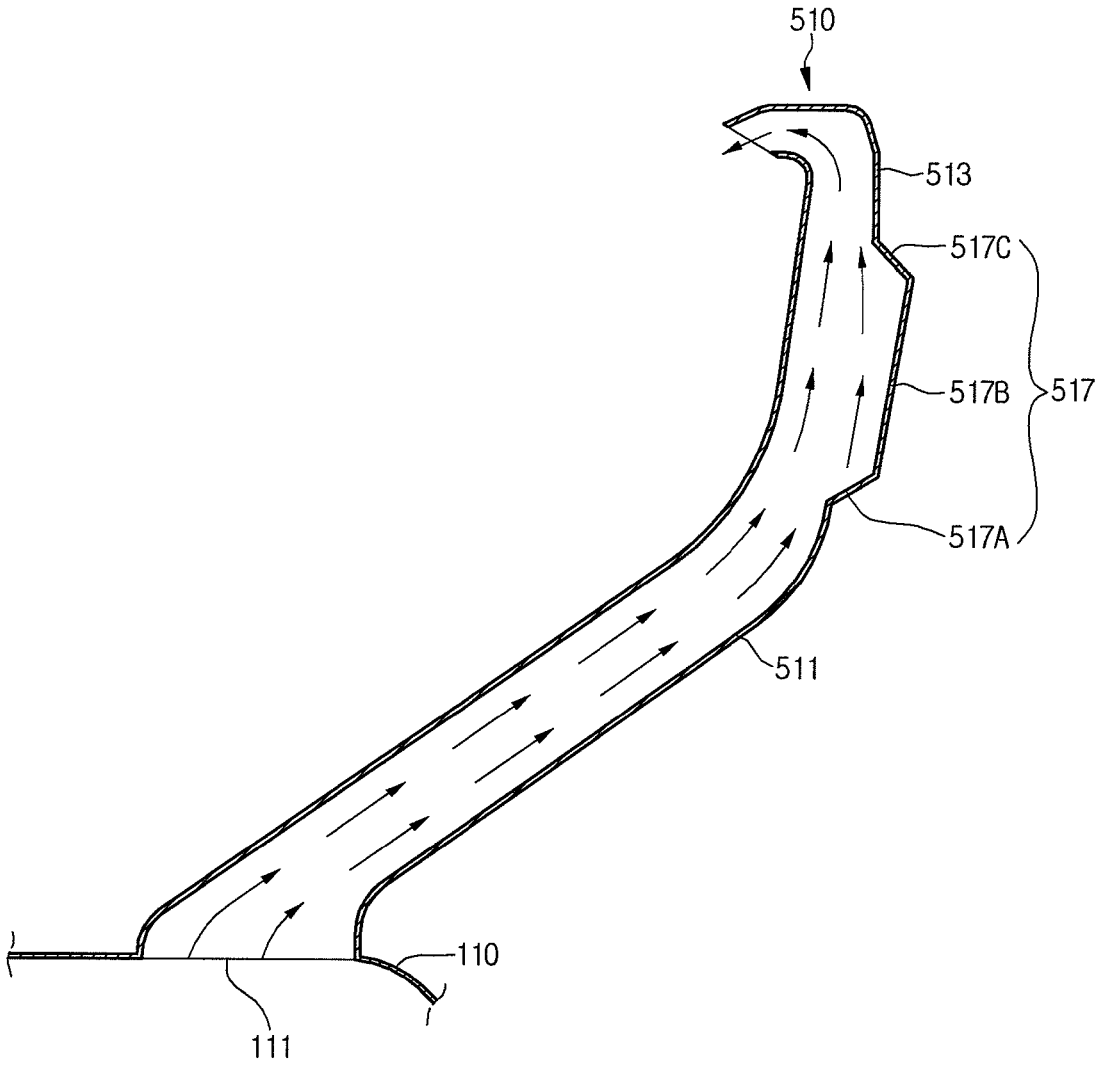
FIG. 6 is a vertical sectional view illustrating flows of exhaust gas in the upper exhaust duct of the cooker according to the first exemplary embodiment.

Referring to FIGS. 5 and 6, in the current exemplary embodiment, the upper exhaust duct 510 includes first and second duct parts 511 and 513 having predetermined lengths. The lower end of the first duct part 511 communicates with the upper exhaust outlet 111. The first duct part 511 extends backward at a predetermined angle from the top surface of the upper cavity part 100, that is, from the upper plate 110. The predetermined angel will now be referred to as a first angle for clarity. The second duct part 513 extends backward from the upper end of the first duct part 511 at a predetermined angle with the upper plate 110. The predetermined angel will now be referred to as a second angle for clarity. The first and second angles are different. In other words, the second duct part 513 extends from the first duct part 511 at a predetermined angle with an imaginary plane parallel with the length direction of the first duct part 511. In the current exemplary embodiment, the second angle is greater than the first angle. Therefore, the angle between the rear surfaces of the first and second duct parts 511 and 513 is greater than the angle between the front surfaces of the first and second duct parts 511 and 513. In the current exemplary embodiment, the first and second duct parts 511 and 513 may be formed as one piece.

A gas transfer opening 515 is formed in the rear surface of the upper exhaust duct 510. Exhaust gas of a lower oven chamber 42 discharged to a lower exhaust duct 49 flows into the upper exhaust duct 510 through the gas transfer opening 515 (described later). In the current exemplary embodiment, the gas transfer opening 515 may be formed by cutting out a portion of the rear surface of the second duct part 513. Alternatively, the gas transfer opening 515 may be formed by cutting out a portion of the rear surface of the first duct part 511. In the current exemplary embodiment, the gas transfer opening 515 is higher than the lower end of the first duct part 511 connected to the upper exhaust outlet 111. In this case, exhaust gas of the lower oven chamber 42 flowing from the lower exhaust duct 49 to the upper exhaust duct 510 can be prevented from flowing into the upper oven chamber 101 through the upper exhaust outlet 111.

In the current exemplary embodiment, the upper exhaust duct 510 includes flow passage extensions 517. The flow passage extensions 517 are formed by protruding portions of the upper exhaust duct 510. Therefore, the sectional area of the upper exhaust duct 510 increases at the flow passage extensions 517.

The flow passage extensions 517 are formed on one of the front and rear surfaces of the second duct part 513 which makes a relatively large angle with the first duct part 511. That is, in the current exemplary embodiment, the flow passage extensions 517 are formed on the rear surface of the second duct part 513. For example, the flow passage extensions 517 may be formed by protruding portions of the rear surface of the second duct part 513 not including the gas transfer opening 515 in a backward direction. The flow passage extensions 517 are disposed at positions close to a position where the flow direction of exhaust gas is changed in the first and second duct parts 511 and 513. That is, the flow passage extensions 517 are close to a connection position between the first and second duct parts 511 and 513.

The flow passage extensions 517 extend in a direction from the lower end to the upper end of the second duct part 513. In addition, the angle between the upper plate 110 and at least portions of the rear surfaces of the flow passage extensions 517 is different from the first and second angles of the first and second duct parts 511 and 513. As described above, the first and second duct parts 511 and 513 extend at different angles with the upper plate 110 (that is, at the first and second angles with the upper plate 110). Therefore, the angle between the first duct part 511 and at least portions of the flow passage extensions 517 may be different from the angle between the first and second duct parts 511 and 513. The first and second duct parts 511 and 513 cross an imaginary plane on which at least portions of the rear surfaces of the flow passage extensions 517 are placed.

In the current exemplary embodiment, each of the rear surfaces of the flow passage extensions 517 includes first to third surfaces 517A, 517B, and 517C that are continuous in the flow direction of exhaust gas in the upper exhaust duct 510. The first surface 517A extends from a position of the rear surface of the second duct part 513 close to the upper end of the first duct part 511. The angle between the first surface 517A and the upper plate 110 is equal to the first angle. The second surface 517B extends from the upper end of the first surface 517A. The angle between the second surface 517B and the upper plate 110 is equal to the second angle. The third surface 517C extends from the upper end of the second surface 517B at a predetermined angle with the upper plate 110 which is different from the first and second angles. Therefore, an imaginary plane on which the third surface 517C is placed may cross the first and second duct parts 511 and 513. However, the angles between the upper plate 110 and the first and second surfaces 517A and 517B are not limited to the first and second angles. That is, like the third surface 517C, the first and second surfaces 517A and 517B may make angles with the upper plate 110 which are different from the first and second angles.

Referring again to FIGS. 1 to 3, the lower oven 40 is disposed in the casing 10 under the upper oven 30. That is, the upper oven 30 and the lower oven 40 are arranged in a vertically stacked manner. The lower oven 40 includes the lower cavity part 41 in which the lower oven chamber 42 is formed, a burner cover 44 disposed on the bottom side of the lower cavity part 41, a lower door 45 used to selectively open and close the lower oven chamber 42, a lower heating source configured to heat the inside of the lower oven chamber 42 for cooking food, and the lower exhaust duct 49 through which exhaust gas is discharged to the outside of the lower oven chamber 42.

Generally, the lower cavity part 41 is disposed under the upper cavity part 100. Like the upper cavity part 100, the lower cavity part 41 has a hexahedral shape with an opened front side. In the current exemplary embodiment, the height of the lower cavity part 41 is greater than that of the upper cavity part 100. A lower exhaust outlet 43 is formed in a rear surface of the lower cavity part 41. Exhaust gas is discharged from the lower oven chamber 42 through the lower exhaust outlet 43.

For example, the lower heating source may include a lower bake burner 47 and a convection device 48. The lower bake burner 47 and the convection device 48 are identical to those of a related-art oven. Thus, detailed descriptions thereof will be omitted.

Exhaust gas of the lower oven chamber 42 is discharged to the outside of the casing 10 through the lower exhaust duct 49. For this, the lower end of the lower exhaust duct 49 is connected to the lower exhaust outlet 43. In addition, the upper end of the lower exhaust duct 49 is connected to a side of the upper exhaust duct 510. Therefore, exhaust gas of the lower oven chamber 42 may be discharged to the outside of the casing 10 sequentially through the lower exhaust duct 49, the upper exhaust duct 510, and the exhaust slot 53.

The control part 50 is disposed at the rear side of the top plate 11. That is, the control part 50 is disposed at the rear end of the topside of the casing 10. The control part 50 is used to receive commands or signals for operating the upper oven 30 and the lower oven 40 and display operational states of the upper oven 30 and the lower oven 40.

The front and lateral sides of the control part 50 are formed by a control panel 51. The front lower end of the control panel 51 is spaced a preset distance from an upper end of the top plate 11. Thus, a predetermined gap is formed between the upper end of the top plate 11 and the front lower end of the control panel 51. In the following description, the gap between the top plate 11 and the control panel 51 will be referred to as the exhaust slot 53. Exhaust gas of the upper oven chamber 101 and lower oven chamber 42 is discharged to the outside of the casing 10 through the exhaust slot 53.

Hereinafter, an exemplary operation of the cooker of the first exemplary embodiment will be described in detail with reference to FIG. 6.

Referring to FIG. 6, while food is cooked in the upper oven chamber 101, exhaust gas is discharged from the upper oven chamber 101 to the outside of the casing 10 through the upper exhaust duct 510. More specifically, exhaust gas of the upper oven chamber 101 flows into the upper exhaust duct 510 (the first and second duct parts 511 and 513) through the upper exhaust outlet 111. The exhaust gas flows from the first duct part 511 to the second duct part 513 where the exhaust gas is discharged to the outside of the casing 10 through the upper end of the second duct part 513.

In the current exemplary embodiment, the cross sectional area of the upper exhaust duct 510 is locally increased at portions of the upper exhaust duct 510 (that is, at portions of the second duct part 513) due to the flow passage extensions 517 formed at the rear surface of the second duct part 513. That is, as a result of the flow passage extensions 517, the cross sectional area of the upper exhaust duct 510 is increased at positions where the flow direction of exhaust gas is varied in the first and second duct parts 511 and 513. Therefore, the flow rate of exhaust gas can be increased in the first and second duct parts 511 and 513, and thus exhaust gas can be efficiently discharged from the upper oven chamber 101.

That is, as a result of the flow passage extensions 517, exhaust gas can be efficiently discharged, as shown by Table 1.

TABLE 1

| | CO (ppm) |
|---|---|
| Related art | 445 |
| Exemplary embodiment | 354 |

Table 1 shows gas concentrations in a related-art upper oven chamber connected to an exhaust duct not having flow passage extensions, and gas concentrations in the upper oven chamber 101 connected to the upper exhaust duct 510 having the flow passage extensions 517, under the conditions where the volumes and pressures of the related-art upper oven chamber and the upper oven chamber 101 are equal. As shown in Table 1, according to the current exemplary embodiment, concentrations of carbon monoxide, carbon dioxide, and nitrogen oxides are significantly low in the upper oven chamber 101 as compared with those in the related-art upper oven chamber. According to the current exemplary embodiment, exhaust gas can be efficiently discharged from the upper oven chamber 101, and combustion of mixture gas in the upper broil burner 200 can be efficiently carried out. Referring to Table 1, this can be understood from the relatively low oxygen concentration in the upper oven chamber 101 of the current exemplary embodiment.

Hereinafter, an explanation will be given of a cooker according to a second exemplary embodiment with reference to FIG. 7. In the second exemplary embodiment, description of the same elements as those of the first exemplary embodiment will not be repeated.

Figure 7:
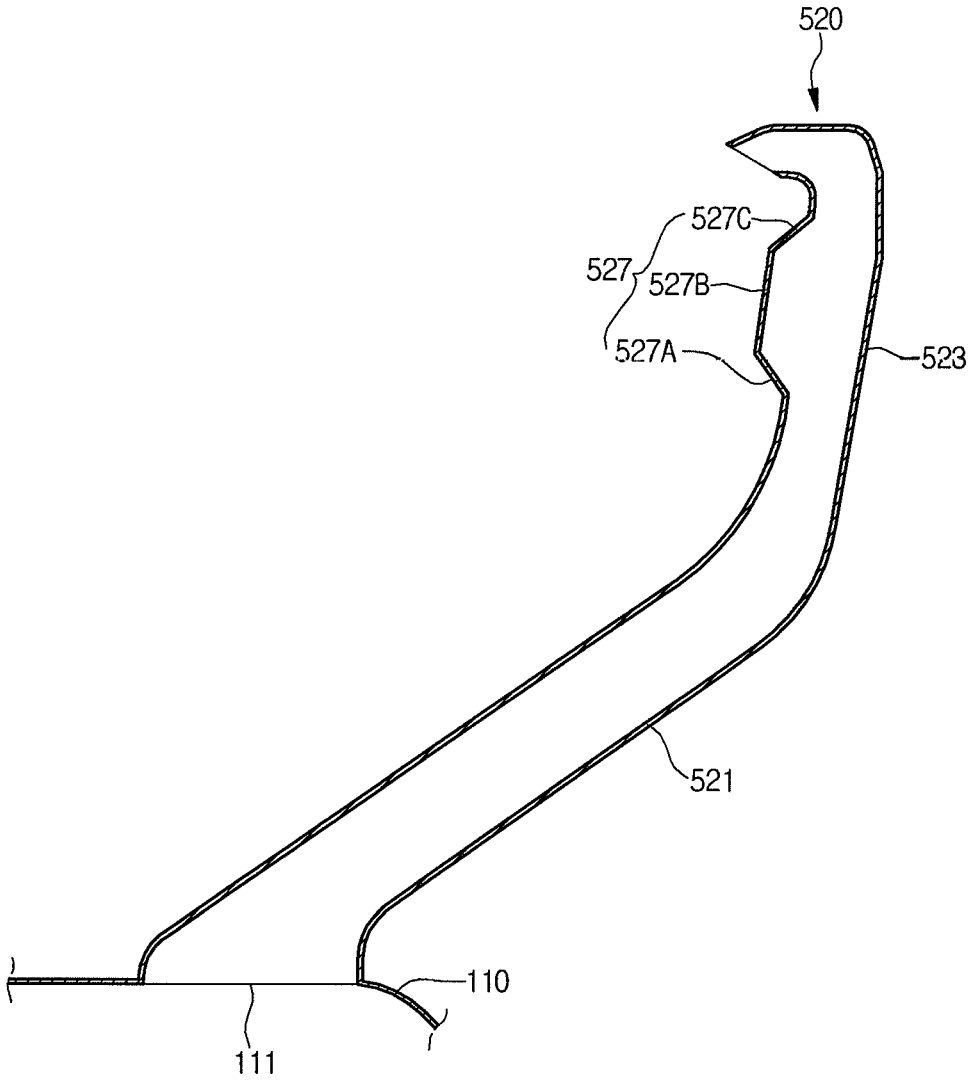
FIG. 7 is a vertical sectional view illustrating an upper exhaust duct of a cooker according to a second exemplary embodiment.

Referring to FIG. 7, a flow passage extension 527 is disposed on the front surface of a second duct part 523 at a position close to the upper end of a first duct part 521. A gas transfer opening (not shown) is formed in the rear surface of the second duct part 523. Therefore, the flow passage extension 527 can be formed on the entire front surface of the second duct part 523 or a portion of the front surface of the second duct part 523. The angle between at least a portion of the front surface of the flow passage extension 527 and the top surface of the upper cavity part 100 (that is, the upper plate 110) is different from the angles (first and second angles) between the upper plate 110 and the first and second duct parts 521 and 523.

A first surface 527A extends from a front position of the second duct part 523 close to the upper end of the first duct part 521. The angle between the first surface 527A and the upper plate 110 is different from the first and second angles. A second surface 527B extends from the upper end of the first surface 527A. The angle between the second surface 527B and the upper plate 110 is equal to the second angle. A third surface 527C extends from the upper end of the second surface 527B. The angle between the third surface 527C and the upper plate 110 is equal to the first angle. Alternatively, the angles between the upper plate 110 and the second and third surfaces 527B and 527C may be different from the first and second angles. According to the current exemplary embodiment, exhaust gas may be discharged from the upper oven chamber 101 more efficiently.

Hereinafter, an explanation will be given of a cooker according to a third exemplary embodiment with reference to FIG. 8. In the third exemplary embodiment, description of the same elements as those of the first exemplary embodiment will not be repeated.

Figure 8:
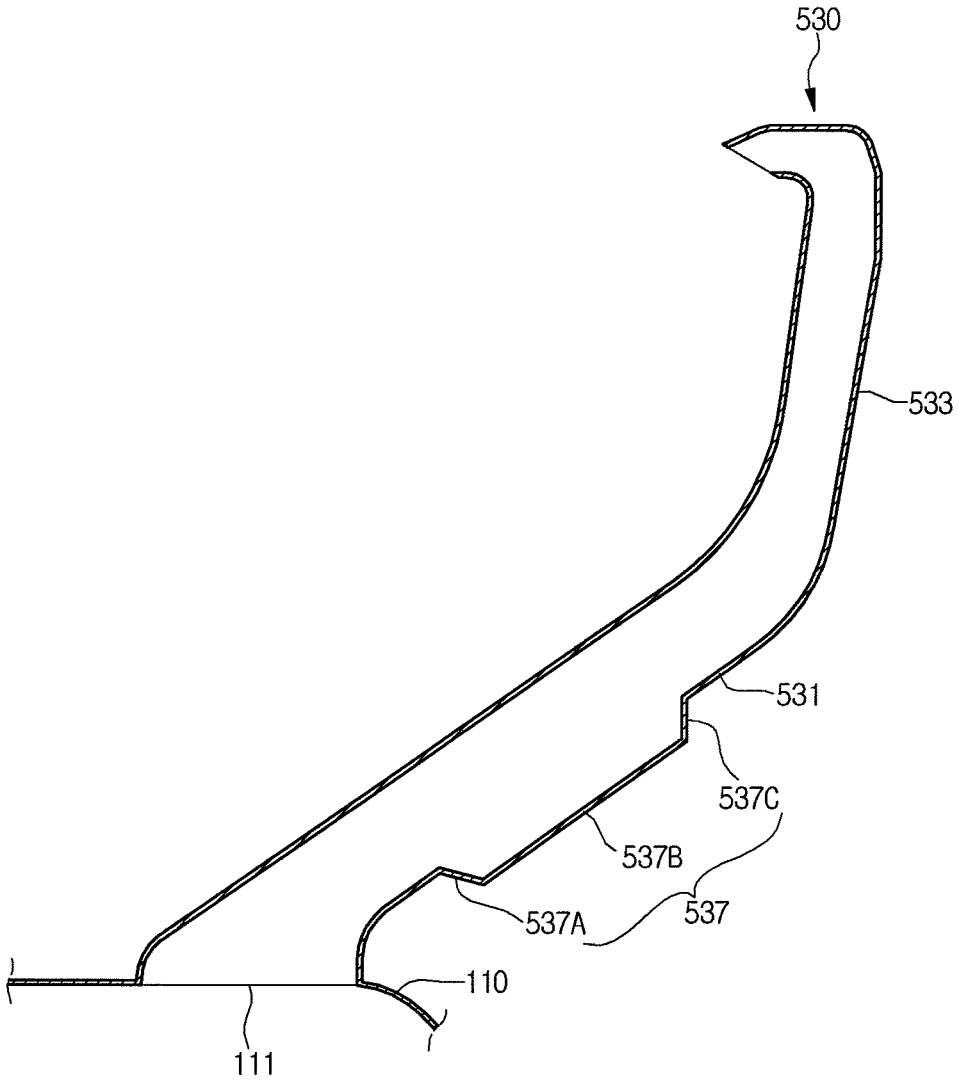
FIG. 8 is a vertical sectional view illustrating an upper exhaust duct of a cooker according to a third exemplary embodiment.

Referring to FIG. 8, a flow passage extension 537 is disposed on the rear surface of a first duct part 531 at a position close to a second duct part 533. In the current exemplary embodiment, regardless of a gas transfer opening (not shown), the flow passage extension 537 can be formed on the entire rear surface of the first duct part 531 or a portion of the rear surface of the first duct part 531. In addition, the angle between at least a portion of the rear surface of the flow passage extension 537 and the top surface of the upper cavity part 100 (that is, the upper plate 110) is different from the angles (first and second angles) between the upper plate 110 and the first and second duct parts 531 and 533.

A first surface 537A extends from a position of the rear surface of the first duct part 531. The angle between the first surface 537A and the upper plate 110 is different from the first and second angles between upper plate 110 and the first and second duct parts 531 and 533. A second surface 537B extends from the upper end of the first surface 537A, and a third surface 537B extends from the upper end of the second surface 537B. The angles between the upper plate 110 and the second and third surfaces are equal to the first and second angles. The upper end of the third surface 537C extends to a position of the rear surface of the first duct part 531 close to the lower end of the second duct part 533.

Hereinafter, an explanation will be given of a cooker according to a fourth exemplary embodiment with reference to FIG. 9. In the fourth exemplary embodiment, description of the same elements as those of the first exemplary embodiment will not be repeated.

Figure 9:
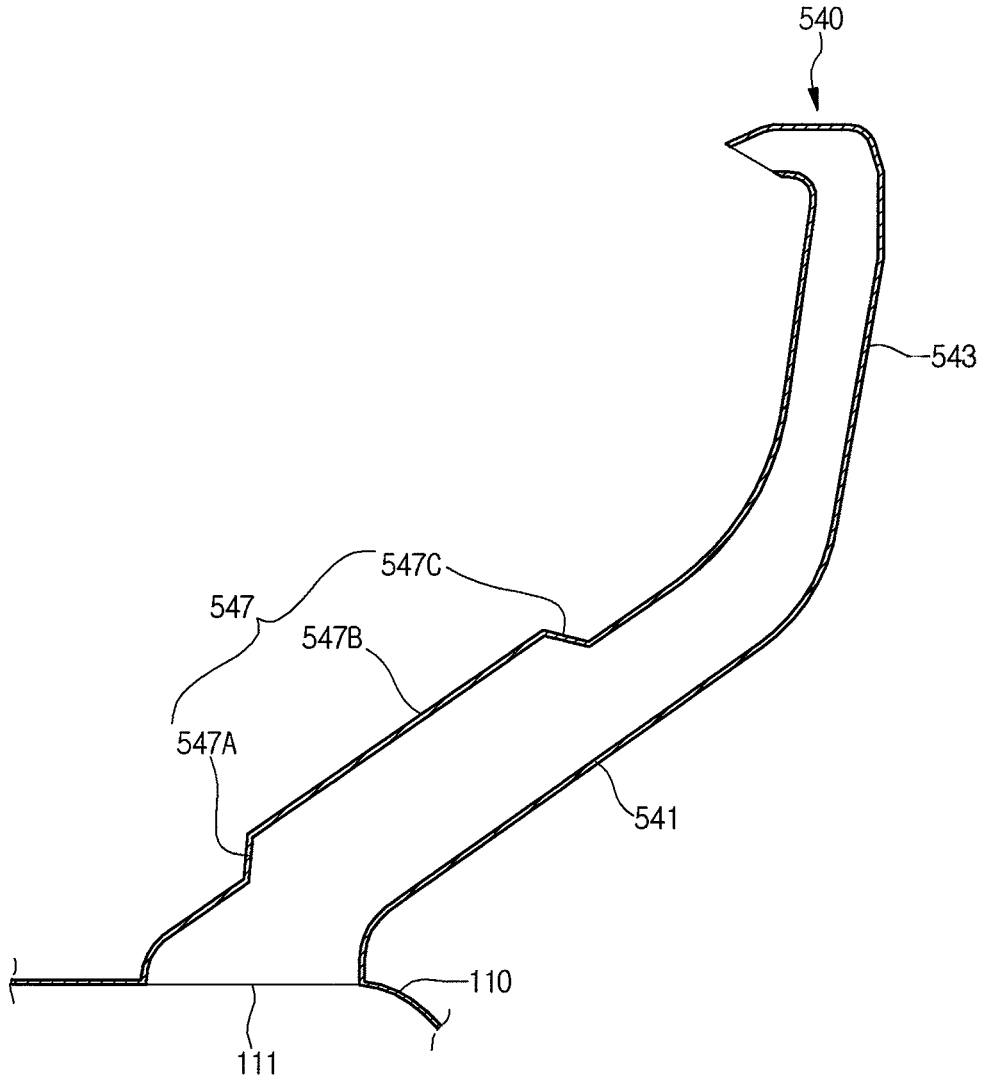
FIG. 9 is a vertical sectional view illustrating an upper exhaust duct of a cooker according to a fourth exemplary embodiment.

Referring to FIG. 9, a flow passage extension 547 is disposed on the first surface of a first duct part 541 at a position close to a second duct part 543. Like in the first to third exemplary embodiments, the position or size of the flow passage extension 547 is not affected by a gas transfer opening 515. That is, the flow passage extension 547 can be formed on the entire front surface of the first duct part 541 or a portion of the front surface of the first duct part 541. In addition, the angle between at least a portion of the front surface of the flow passage extension 547 and the top surface of the upper cavity part 100 (that is, the upper plate 110) is different from the angles (first and second angles) between the upper plate 110 and the first and second duct parts 541 and 543.

A first surface 547A extends from the front surface of the first duct part 541, and the angle between the first surface 547A and the upper plate 110 is equal to the second angle. A second surface 547B extends from the upper end of the first surface 547A, and the angle between the second surface 547B and the upper plate 110 is equal to the first angle. A third surface 547C extends from the upper end of the second surface 547B, and the angle between the third surface 547C and the upper plate 110 is different from the first and second angles. The upper end of the third surface 547C extends to a position of the front surface of the first duct part 541 close to the lower end of the second duct part 543.

Hereinafter, explanations will be given of cookers according to fifth to eighth exemplary embodiments with reference to FIGS. 10 to 13. In the fifth to eighth exemplary embodiment, description of the same elements as those of the first exemplary embodiment will not be repeated.

Referring to FIGS. 10 to 13, in the fifth to eighth exemplary embodiments, second duct parts 553, 563, 573, and 583 having predetermined curvatures may extend from the upper ends of first duct parts 551, 561, 571, and 581. In the fifth to eighth exemplary embodiments, flow passage extensions 557, 567, 577, and 587 are disposed at different positions.

Figure 10:
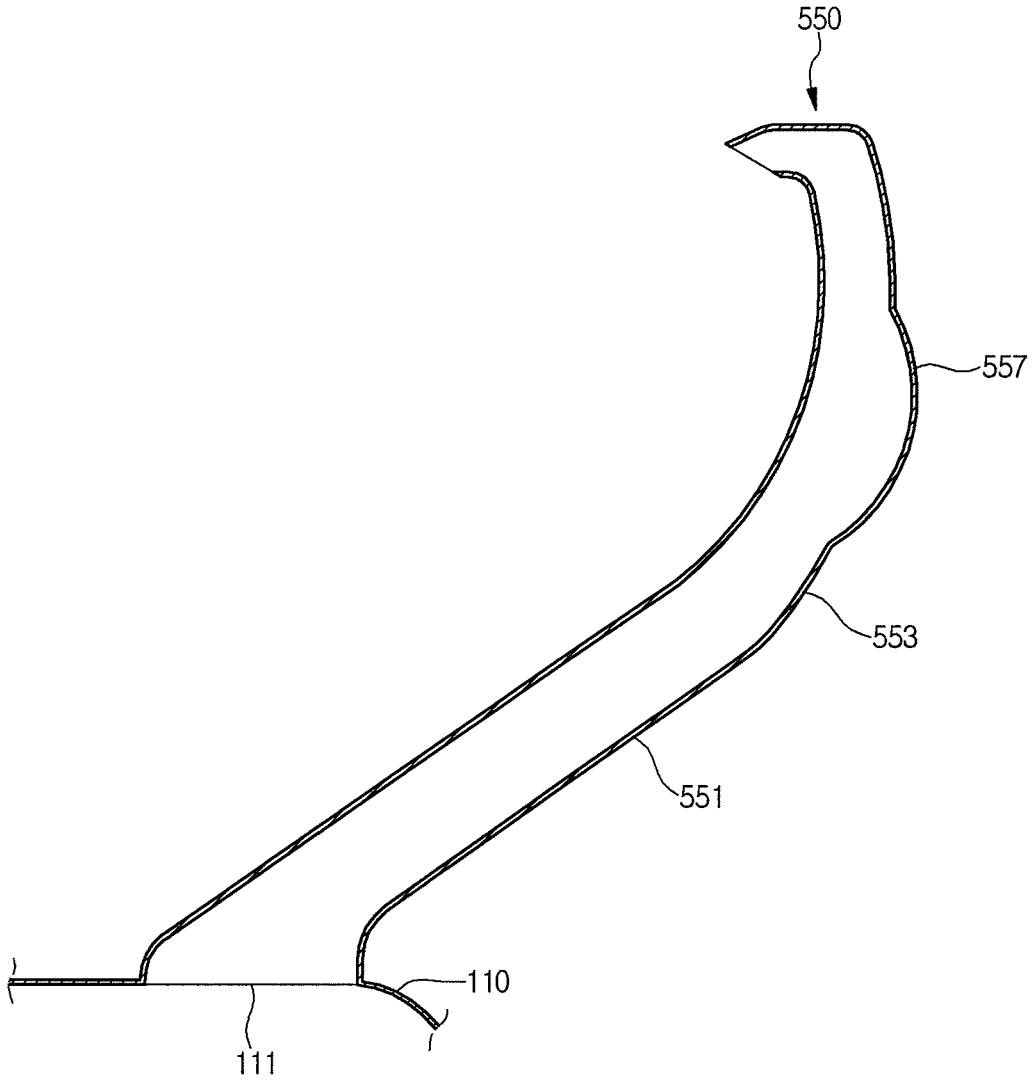
FIG. 10 is a vertical sectional view illustrating an upper exhaust duct of a cooker according to a fifth exemplary embodiment.
Figure 11:
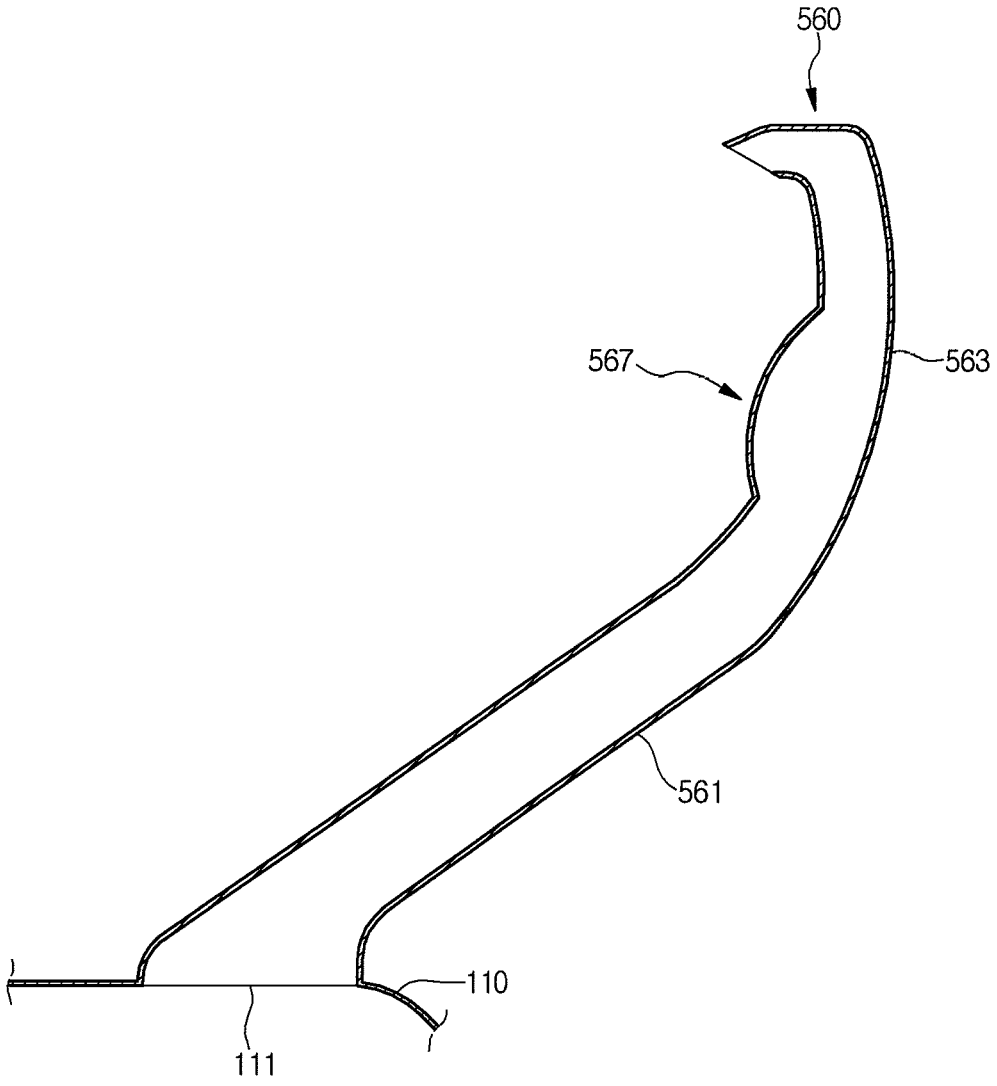
FIG. 11 is a vertical sectional view illustrating an upper exhaust duct of a cooker according to a sixth exemplary embodiment.
Figure 12:
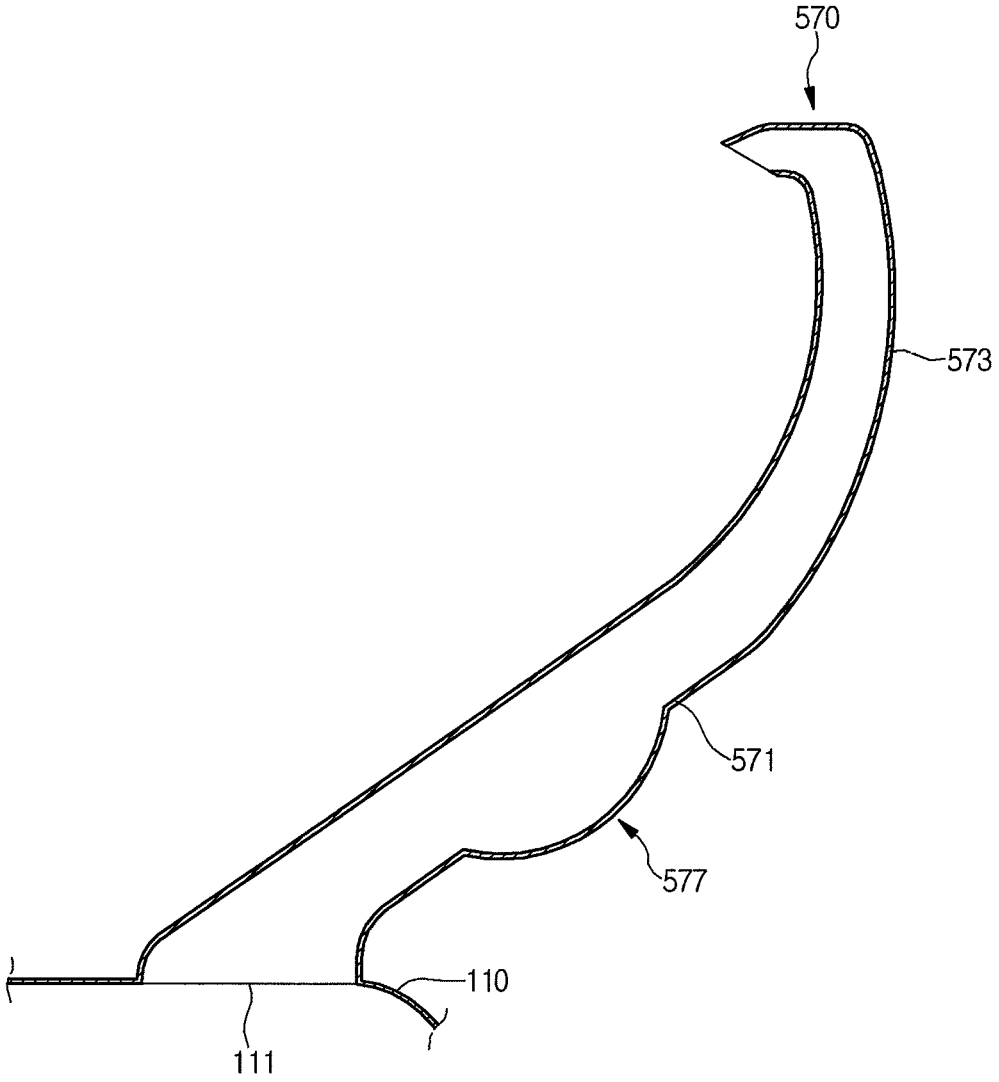
FIG. 12 is a vertical sectional view illustrating an upper exhaust duct of a cooker according to a seventh exemplary embodiment.
Figure 13:
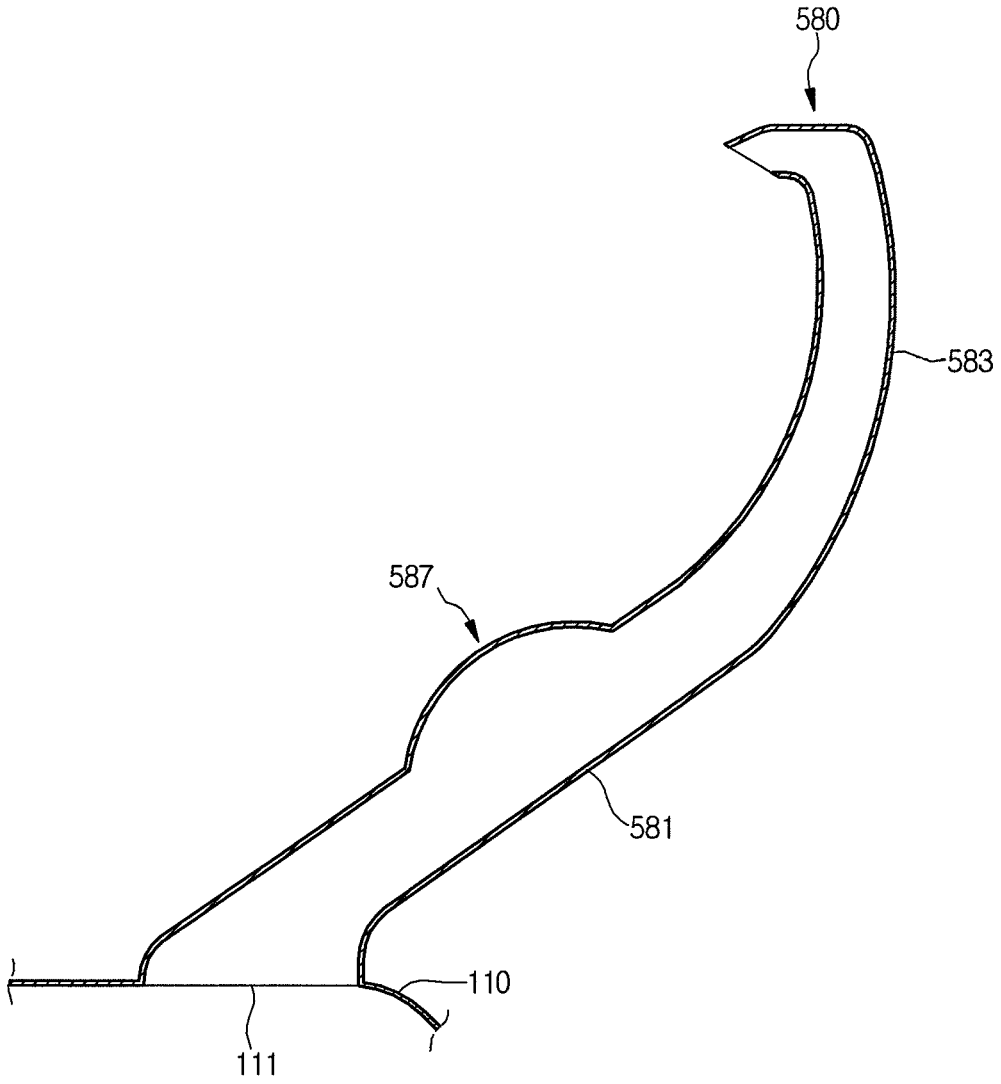
FIG. 13 is a vertical sectional view illustrating an upper exhaust duct of a cooker according to an eighth exemplary embodiment

Referring to FIG. 10, in the fifth exemplary embodiment, the flow passage extension 557 is provided on the rear surface of the second duct part 553 at a position close to the upper end of the first duct part 551. Referring to FIG. 11, in the sixth exemplary embodiment, the flow passage extension 567 is provided on the front surface of the second duct part 563 at a position close to the upper end of the first duct part 561. Referring to FIGS. 12 and 13, in the seventh and eighth exemplary embodiments, the flow passage extensions 577 and 587 are provided on the rear and front surfaces of the first duct parts 571 and 581 at positions close to the lower ends of the second duct part 573 and 583, respectively.

In the fifth to eighth exemplary embodiments, the flow passage extensions 557, 567, 577, and 587 have curvatures different from those of the second duct parts 553, 563, 573, and 583. More particularly, in the fifth to eighth exemplary embodiments, the curvatures of the flow passage extensions 557, 567, 577, and 587 are greater than the curvatures of the second duct parts 553, 563, 573, and 583, respectively.

According to the cooker of the exemplary embodiments, exhaust gas can be efficiently discharged through the exhaust duct while food is cooked in the cooking chamber. Therefore, food can be cooked in the cooking chamber more efficiently.

In the above-described exemplary embodiments, the terms upper and lower oven chambers are used to denote spaces for cooking food. Thus, the upper and lower oven chambers may also be referred to as upper and lower cooking chambers, respectively.

In the above-described exemplary embodiments, the upper end of the lower exhaust duct is connected to the upper exhaust duct. However, the upper end of the lower exhaust duct may be directly connected to the exhaust slot. In addition, a portion of the lower exhaust duct may be disposed in the upper exhaust duct.

In the above-described exemplary embodiments, the upper heating source includes the upper broil burner and the upper bake burner. In addition, the upper heating source may further include a convection device. Similarly, the lower heating source may further include a lower broil burner. In addition, one of the lower bake burner and the convection device of the lower heating source may be omitted. Moreover, like the upper broil burner, the upper bake burner, the lower broil burner, and the lower bake burner may be infrared burners.

In the above-described exemplary embodiments, the flow passage extension is provided on one of the front and rear surfaces of the first duct part or the second duct part. However, in other exemplary embodiments, at least two flow passage extensions may be provided on the front and rear surfaces of the first duct part and/or the second duct part.

In the above-described exemplary embodiments, the upper exhaust outlet is the upper surface of the upper cavity part. However, the upper exhaust outlet may be formed in the rear surface of the upper cavity part according to the size of the upper cavity part.

In the above-described exemplary embodiments, the flow passage extension includes first to third surfaces which are continuously arranged in the flow direction of exhaust gas in the upper exhaust duct. However, in other exemplary embodiments, the flow passage extension may include two or at least four surfaces.

In the above-described, the mixing tubes are disposed in the upper oven chamber. However, the positions of the mixing tubes are not limited thereto. For example, the mixing tubes may be disposed at the rear surface of the upper cavity part. That is, the mixing tubes may be disposed in the casing through the rear plate.

Although exemplary embodiments have been described with reference to a number of illustrative exemplary embodiments thereof, it should be understood that numerous other modifications and exemplary embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooker comprising:

a casing defining an exterior of the cooker;

a cavity part disposed in the casing and including a cooking chamber configured to cook food; and an exhaust duct through which exhaust gas is discharged from the cooking chamber to an outside area of the casing, the exhaust duct including:

a first duct part having a lower end communicating with the cooking chamber;

a second duct part extending from the other end of the first duct part, the second duct part making a predetermined angle with respect to the first duct part or having a predetermined curvature; and a flow passage extension protruded from a portion of the first duct part or the second duct part in an outward direction, wherein at least a portion of the flow passage extension extends at an angle different from the predetermined angle between the first and second duct parts or the flow passage extension has a curvature different from the predetermined curvature of the second part, wherein the flow passage extension includes a plurality of surfaces continuously arranged in a flow direction of exhaust gas in the first and second duct parts, and wherein at least one of the surfaces of the flow passage extension extends at an angle different from the predetermined angle between the first and second duct parts.

2. The cooker according to claim 1, further comprising a control panel disposed on a top surface of the casing, wherein the lower end of the first duct part is fixed to a top surface or a rear surface of the cavity part and communicates with the cooking chamber, and wherein an upper end of the second duct part communicates with an outside area through a portion of the control panel.

3. The cooker according to claim 1, wherein the flow passage extension is disposed close to a connection position between the first and second duct parts.

4. The cooker according to claim 1, wherein the flow passage extension has a curvature greater than the curvature of the second duct part.

5. The cooker according to claim 1, further comprising a burner configured to supply energy to the cooking chamber for cooking food.

6. The cooker according to claim 1, wherein the flow passage extension includes a pair of flow passage extensions.

7. The cooker according to claim 6, wherein the upper exhaust passage includes a gas transfer opening, and wherein the pair of flow passage extensions are formed on opposite sides of the gas transfer opening.

8. A cooker comprising:

a casing defining an exterior of the cooker;

an upper cavity part disposed in the casing and including an upper cooking chamber configured to cook food;

an upper burner configured to supply energy to the upper cooking chamber for cooking food;

an upper exhaust duct to which exhaust gas flows from the upper cooking chamber;

a lower cavity part disposed in the casing under the upper cavity part and including a lower cooking chamber configured to cook food;

a lower burner configured to supply energy to the lower cooking chamber for cooking food; and a lower exhaust duct to which exhaust gas flows from the lower cooking chamber, wherein the upper exhaust duct includes:

a first duct part having a lower end communicating with the upper cooking chamber, the first duct part being sloped at a first angle with respect to a top surface of the upper cavity part;

a second duct part communicating with an upper end of the first duct part, the second duct part being sloped at a second angle with respect to the top surface of the upper cavity part or the second duct part having a predetermined curvature, wherein the first duct part and the second duct part are formed as one body; and a flow passage extension protruded from a portion of the first duct part or the second duct part in an outward direction, wherein at least a portion of the flow passage extension extends at an angle different from the first and second angles or the flow passage extension has a curvature different from the predetermined curvature of the second duct part, wherein the flow passage extension includes at least one surface that extends at an angle different from the predetermined angle between the first and second duct parts, wherein exhaust gas of the upper cooking chamber is guided to the outside area of the casing through the upper exhaust duct, and exhaust gas of the lower cooking chamber is guided to the upper exhaust duct through the lower exhaust duct, wherein a portion of the upper exhaust duct includes a gas transfer opening, wherein an upper end of the lower exhaust duct is connected to the portion of the rear surface of the upper exhaust duct at the gas transfer opening, wherein the flow passage extension is provided on another portion of the upper exhaust duct at a location where the gas transfer opening is not provided, and wherein the flow passage extension includes a pair of flow passage extensions.

9. The cooker according to claim 8, further comprising a control panel disposed on a top surface of the casing, wherein the lower end of the first duct part is fixed to the top surface of the upper cavity part and communicates with the upper cooking chamber, and wherein an upper end of the second duct part communicates with an outside area through a portion of the control panel.

10. The cooker according to claim 8, wherein the flow passage extension is disposed close to a connection position between the first and second duct parts.

11. The cooker according to claim 8, wherein the flow passage extension has a curvature greater than the curvature of the second duct part.

12. The cooker according to claim 8, wherein the pair of flow passage extensions are formed on opposite sides of the gas transfer opening.

* * * * *